United States Patent [19]

Kondo et al.

[11] Patent Number: 4,581,311

[45] Date of Patent: Apr. 8, 1986

[54] PHOTOCONDUCTIVE COMPOSITION WITH VINYLIDENE CHLORIDE-ACRYLONITRILE COPOLYMER ADDITIVE

[75] Inventors: Shunichi Kondo; Kenji Sano; Hideo Sato, all of Saitama, Japan

[73] Assignee: Fuji Photo Film Co., Ltd., Kanagawa, Japan

[21] Appl. No.: 731,615

[22] Filed: May 7, 1985

Related U.S. Application Data

[63] Continuation of Ser. No. 625,584, Jun. 29, 1984, abandoned, which is a continuation of Ser. No. 405,777, Aug. 6, 1982, abandoned.

[30] Foreign Application Priority Data

Aug. 6, 1981 [JP] Japan ..... 56-123324

[51] Int. Cl.[4] ..... G03G 5/07; G03G 5/06

[52] U.S. Cl. ..... 430/80; 430/96

[58] Field of Search ..... 430/80, 96

[56] References Cited

U.S. PATENT DOCUMENTS

| | | | |
|---|---|---|---|
| 3,037,861 | 6/1962 | Hoegl et al. | 430/80 |
| 3,268,332 | 8/1966 | Caruso et al. | 430/96 |
| 3,331,687 | 7/1967 | Kosche | 430/80 X |
| 3,567,450 | 3/1971 | Brantly et al. | 430/96 X |
| 3,765,884 | 10/1973 | Shea | 430/96 X |
| 4,301,226 | 11/1981 | Contois et al. | 430/96 X |

*Primary Examiner*—Roland E. Martin

*Attorney, Agent, or Firm*—Sughrue, Mion, Zinn, Macpeak, and Seas

[57] ABSTRACT

A photoconductive composition is disclosed which contains an organic photoconductor and a vinylidene chloride-acrylonitrile copolymer. Furthermore, there is disclosed an electrophotographic photoreceptive material using such a photoconductive composition as its photoreceptive layer. The material has improved flexibility while maintaining desirable electrophotographic characteristics.

20 Claims, No Drawings

PHOTOCONDUCTIVE COMPOSITION WITH VINYLIDENE CHLORIDE-ACRYLONITRILE COPOLYMER ADDITIVE

This is a continuation of application Ser. No. 625,584, filed June 29, 1984, now abandoned, which is a continuation of application Ser. No. 405,777 filed Aug. 6, 1982, now abandoned.

FIELD OF THE INVENTION

The present invention relates to a photoconductive composition which can impart flexibility to an electrophotographic photoreceptive layer without reducing its resistivity against dark decay and photosensitivity, and to an electrophotographic photoreceptive material using such a photoconductive composition.

BACKGROUND OF THE INVENTION

Macromolecular organic photoconductors themselves possess film forming ability. Accordingly, it is not necessary to use a film forming binder in combination with macromolecular organic photoconductors when forming an electrophotographic photoreceptive layer (electrophotographic photoreceptive film). The macromolecular organic photoconductor can be used to form the photoreceptive layer by itself. However, films of poly-N-vinylcarbazole and other macromolecular organic photoconductors, including polyvinyl triphenylpyrazoline, polyacenaphthylene and the like, are very fragile.

When using a macromolecular organic photoconductor as an electrophotographic photoreceptive layer, the photoconductor is generally dissolved in an appropriate solvent and coated on a support. Under such a circumstance, when using fibrous porous material, like paper, as a support, the macromolecular organic photoconductor can permeate into the support. Because of the permeation into and bonding with the paper, such material is useful despite its own inflexible property. However, when the macromolecular organic photoconductor is laminated on a smooth support surface, like a metal plate or a plastic film, there occurs a disadvantageous phenomenon in that the electrophotographic photoreceptive layer is distorted by shrinkage accompanying the evaporation of the solvent therefrom. Accordingly, it is cleaved from or delaminated from the support.

In addition, a film of a macromolecular organic photoconductor is generally brittle. Consequently, when it is processed into an electrophotographic film or sheet, the electrophotographic photoreceptive layer will often break along cut planes when the film or sheet is cut or slit in order to form the finished goods. Furthermore, crevices may generated by bending the film or sheet during handling or when it is conveyed in the form of roll film. Accordingly, it cannot be submitted to practical use if it is left as it is.

An attempt has been made to eliminate the inherent brittleness of such macromolecular organic photoconductors by copolymerization with monomers having an intramolecular plasticizing effect (Japanese patent publication Nos. 24753/68, 43955/71 and 18780/75). However, if the fraction of such monomers is increased till sufficient plasticizing effect is attained, electrophotographic characteristics are deteriorated and the original functions as the photoconductor are lost. In accordance with another known method of softening macromolecular organic photoconductors, certain substances are included as additives. These and other techniques are disclosed in, e.g., Japanese patent publication Nos. 14527/75, 18780/75 and 5943/76; Japanese patent application (OPI) Nos. 19442/75, 115039/75 and 115536/75 (the term "OPI" as used herein refers to a "published unexamined Japanese patent application"); and so on. However, these techniques cause deterioration of electrophotographic characteristics if they are utilized to the extent that sufficient flexibility is aquired. More specifically, when utilizing these techniques, obtaining good flexibility is incompatible with obtaining desirable electrophotographic characteristics.

SUMMARY OF THE INVENTION

An object of the present invention is to present an electrophotographic photoreceptive material which eliminates the disadvantages of prior art materials as pointed out above.

Another object of the present invention is to present an electrophotographic photoreceptive material having high flexibility.

Yet another object of the present invention is to present an electrophotographic photoreceptive material having excellent electrophotographic characteristics.

Another object of the present invention is to present a novel photoconductive composition which can be used on a support base to produce an electrophotographic photoreceptive material which can achieve the objects as indicated above.

Another object of the present invention is to present such a photoconductive composition and electrophotographic photoreceptive material using that composition which can be easily produced at a low cost utilizing components which are readily available.

The above-described objects of the present invention are attained with (1) a photoconductive composition containing an organic photoconductor and a vinylidene chloride-acrylonitrile copolymer, and with (2) an electrophotographic photoreceptive material which has on a support, which is conductive at least in its surface part, an electrophotographic photoreceptive layer made up of a photoconductive composition containing an organic photoconductor and a vinylidene chloride-acrylonitrile copolymer.

DETAILED DESCRIPTION OF THE INVENTION

A wide range of well known organic photoconductors which can be employed in this invention. Because these substances are known, specific enumeration of them is omitted. Specific examples of organic photoconductors are disclosed in *Research Disclosure*, #10938 (May, 1973), pp. 61- , the heading of "Electrophotographic Element, Material and Process" should be referred to. Macromolecular organic photoconductors are preferably used in this invention as the organic photoconductor. Specific examples of such macromolecular organic photoconductors include vinyl polymer type photoconductors which contain $\pi$-electron systems having polycyclic aromatic rings of aromatic heterocyclic rings in their main chains or side chains. The molecular weight of the macromolecular organic photoconductor preferably ranges from 100,000 to 1,000,000, more preferably 200,000 to 700,000.

Typical representative $\pi$-electron systems contained in macromolecular organic photoconductors include polycyclic aromatic hydrocarbons such as naphthalene, anthracene, pyrene, perylene, acenaphthene, phenylanthracene, diphenylanthracene, etc.; aromatic heterocyclic compounds such as carbazole, indole, acridine, 2-phenylindole, N-phenylcarbazole, etc.; and halogen or lower alkyl substitution products thereof. In the present invention, polymers having $\pi$-electron systems as described above are employed as photoconductive polymers.

Examples of such polymers include homopolymers or copolymers such as vinyl copolymers such as polyvinylnaphthalene, polyvinylanthracene, polyvinylpyrene, polyvinylperylene, polyacenaphthylene, polystyrylanthracene, polyvinylcarbazole, polyvinylindole, polyvinyl acridine, etc.; vinyl ether polymers such as polyanthrylmethyl vinyl ether, polypyrenylmethyl vinyl ether, polycarbazolylethyl vinyl ether, polyindolylethyl vinyl ether, etc.; epoxy resins such as polyglycidylcarbazole, polyglycidylindole, poly-p-glycidylanthrylbenzene, etc.; and polyacrylic acid esters and polymethacrylic acid esters which each contains one of the above-described $\pi$-electron systems as substituents: and condensed polymers prepared from compounds containing the above-described $\pi$-electron systems and formaldehyde.

Among these polymers, poly-N-vinylcarbazole, poly-N-vinylcarbazoles having on their individual carbazole rings such substituents as an aryl group, e.g., a phenyl group, an alkylaryl group, e.g., a benzyl group, an amino group, an alkylamino group having 1 to 5 carbon atoms, a dialkylamino group, alkyl moiety having 1 to 5 carbon atoms, an arylamino group, e.g., a phenylamino group, a diarylamino group, e.g., a diphenylamino group, an N-alkyl-N-arylamino group, wherein the alkyl moiety has 1 to 5 carbon atoms and the aryl moiety has 6 to 7 carbon atoms, nitro group, a halogen atom and so on (which are called poly-N-vinyl substituted carbazoles hereinafter), and N-vinylcarbazole copolymers are particularly preferable.

Preferably used N-vinylcarbazole copolymers include copolymers containing an N-ethylenecarbazole constitutional repeating unit in a fraction of 50 mole % or more and having 100,000 to 1,000,000 of molecular weight, the N-ethylenecarbazole unit being represented by the following general formula:

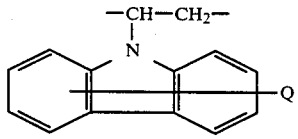

(wherein Q represents a substituent selected from the same groups as those mentioned as substituents which the above-described poly-N-vinyl substituted carbazoles can have). Residual constitutional repeating units which the N-vinylcarbazole copolymers can have, include: 1-phenylethylene, 1-cyanoethylene, 1-cyano-1-methylethylene, 1-chloroethylene, 1-(alkoxycarbonyl-)ethylene and 1-alkoxycarbonyl-1-methylethylene (wherein they are the constitutional repeating units derived from styrene, acrylonitrile, methacrylonitrile, vinyl chloride, alkylacrylate and alkylmethacrylate, respectively, and an alkyl moiety of the alkoxycarbonyl group includes those having 1 to 18 carbon atoms, such as methyl, ethyl, hexyl, lauryl, stearyl and 4-methylcyclohexyl). The term constitutional repeating unit (which is abbreviated as CRU hereinafter) in the present invention obeys the definition in *Kobunshi,* vol. 27, pp. 345–359 (1978) (which corresponds to Japanese translation of *Pure and Applied Chemistry,* vol. 48, pp. 373–385 (1976).

Vinylidene chloride-acrylonitrile copolymers to be employed in the present invention are soluble in certain solvents, and having preferably 10,000 to 100,000 of molecular weight. With respect to such copolymers preferable ones include those having linear structures and ratios of CRU derived from vinylidene chloride to CRU derived from acrylonitrile ranging from about 1:3 to about 4:1. Furthermore, such preferred copolymers should be soluble in organic solvents such as 1,2-dichloroethane, 1,1,1-trichloroethane, acetone, tetrahydrofuran, N,N-dimethylformamide and the like at room temperatures (from about 10° C. to about 35° C.) or in mildly heated conditions (up to temperatures ranging from about 35° C. to about 80° C.). These vinylidene chloride-acrylonitrile copolymers are generally used as a vehicle for coating materials, and specific examples thereof include Saran Resin F-120, F-220, F-242 (the foregoing are products of Dow Chemical Co.), F-216, R-200, R-202 (the foregoing are products of Asahi Dow Ltd.) and so on. Saran resin F-120 has 1.60 of specific gravity, 570 to 715 kg/cm$^2$ of tensile strength, and 8 to 10% of extension strength; F-220 has 1.60 of specific gravity, 500 to 530 kg/cm$^2$ of tensile strength and 0 to 10% of extension strength; and F-242 has 1.69 of specific gravity.

The vinylidene chloride-acrylonitrile copolymer can be used in an amount of 0.1 to 30 parts by weight, preferably 0.5 to 10 parts by weight, per 100 parts by weight of the macromolecular organic photoconductor.

In addition to the above-described two components, the photoconductive composition of the present invention can optionally contain known sensitizers, binders, dyes, pigments and so on. Such additives may be present in a range such that they do not deteriorate the characteristics of the composition. Further, the composition can be spectrally sensitized with dyes (or coloring matter). In addition, it can contain polyaryl compounds, isocyanate compounds and epoxy compounds.

The photoconductive composition of the present invention can be prepared by dissolving the above-described two essential components and other optional components in an appropriate solvent in their respective desirable amounts to make a homogeneous solution (the solution of a photoconductive composition). The solvent is then removed from the solution (through e.g., evaporation). Also, a solution of photoconductive composition can be used as it is without removing the solvent depending upon its end-use purpose. An electrophotographic photoreceptive material of the present invention is generally obtained using the thus prepared solution of photoconductive composition in the form of photoconductive layer (electrophotographic photoreceptive layer) provided on an appropriate support having a conductive surface by coating and subsequent drying treatments. It is then possible to laminate an adhesive layer and the like depending upon the desired end-use.

Solvents which can be generally used include those which can dissolve both the macromolecular organic photoconductor and the vinylidene chloride-acrylonitrile copolymer, such as tetrahydrofran, acetone, 1,1,1-trichloroethane, 1,2-dichloroethane, N,N-dimethylacetoamide, N,N-dimethylformamide and the like.

Examples of supports having a conductive surface which can be used include drums or sheets of such metals as aluminum, copper, iron, zinc and the like; and paper sheets, plastic films, glass plates and so on whose respective surfaces are rendered electrically conductive by evaporating a metal, $SnO_2$ or $In_2O_3$ thereonto, by laminating a metallic foil thereon, by coating thereon a dispersion of $SnO_2$ fine particles, $In_2O_3$ fine particles, CuI fine particles, carbon black or a metal powder dispersed in a binder polymer, or by using other methods. Among them, $In_2O_3$ evaporated polyethylene terephthalate (hereafter PET) film and PET film having $SnO_2$ fine powder dispersed in gelatin are most preferable.

The photoconductive composition of the present invention can also be used in the form of suspension which is prepared by pulverizing the composition and dispersing the resulting powder in an insulating liquid. In this case, the photoconductive composition can provide an image using the liquid electrophoretic imaging photographic process described in U.S. Pat. No. 3,384,565 (corresponding to Japanese Patent Publication No. 21781/68), U.S. Pat. No. 3,384,488 (corresponding to Japanese patent publication No. 37125/72), U.S. Pat. No. 3,510,419 (corresponding to Japanese patent publication No. 36079/71) and so on.

Electrophotographic characteristics, in the xerography which is a representative type of electrophotographic process, are roughly divided into those related to the latent image forming step, and those related to the latent image visualizing step which comprises developing processing and fixing processing. The characteristics with respect to the latent image forming step can be further evaluated with respect to characteristics related to charge acceptance. More specifically, the characteristic can be further evaluated with respect to the maximum surface charge density that can be applied to the electrophotographic photoreceptive layer (photoconductive insulating layer), characteristic related to dark decay of accepted surface charge, and characteristics related to decay of accepted surface potential by exposure to light.

The aforementioned conventional techniques for softening macromolecular organic photoconductors cause many undesirable phenomena. For example, the intramolecular plasticizing technique utilizing copolymerization tends to especially increase the residual potential due to deterioration of light decay functions and to decrease the photosensitivity. On the other hand, the technique of adding a plasticizer causes dielectric breakdown in the photoreceptive layer. This happens when the plasticizer is added in such an amount as to impart sufficient flexibility to the photoreceptive layer and thereby, defects in images are brought about or dark decay is increased.

In the composition of the present invention, the vinylidene chloride-acrylonitrile copolymer acts so as to reinforce the macromolecular organic photoconductor. The copolymer can increase film strength even if it is added in a relatively small amount. Therefore, addition of the vinylidene chloride-acrylonitrile copolymer does not cause deterioration of the above-described electrophotographic characteristics. In addition, the adhesiveness of the photoreceptive layer to the support (conductive layer) can be remarkably improved by the addition of the vinylidene chloride-acrylonitrile copolymer in a small amount.

Further, the addition of a conventionally used, known plasticizer to the film (the photoreceptive layer) in such an amount as to impart sufficient flexibility thereto tends to cause a blocking phenomenon of the film. This leads to sticking of electrophotographic photoreceptive sheets (or films) at their facing surfaces when they are stored in a pressed state, e.g., upon storage in the form of roll. However, the problem as described above can be solved using the composition of the present invention.

The present invention will now be illustrated in more detail by reference to the following examples. However, this invention is not limited to these specific examples.

EXAMPLE 1

1 g of poly-N-vinylcarbazole (PVCz) was dissolved in 20 ml of 1,2-dichloromethane to prepare a solution and thereto, 25 mg of 2,6-di-t-butyl-4-[4-(methyl-N-2-cyanoethylamino)styryl]thiapyrylium tetrafluoroborate was added. A portion of the resulting solution was coated on a 100 μm-thick polyethylene terephthalate (PET) film having a 60 μm-thick $In_2O_3$-evaporated layer (which was provided in order to impart conductivity to the PET film), and dried to remove the solvent therefrom. Thus, a photoconductive layer having a thickness of 5 μm (electrophotographic photoreceptive layer) was formed, and the thus obtained film was named the electrophotographic film No. 1.

Another portion of the solution was divided into six fractions and thereto, Saran Resin R-202 (vinylidene chloride-acrylonitrile copolymer) were added in amounts of 0.5 part by weight, 1 part by weight, 2 parts by weight, 3 parts by weight, 5 parts by weight and 10 parts by weight, respectively, per 100 parts by weight of PVCz. On an $In_2O_3$-evaporated PET film, each of these solutions was coated in the same manner as described above, and dried to remove the solvent therefrom. Thus, photoconductive layers having a thickness of 5 μm were provided on the individual PET films, and they were named electrophotographic films No. 2, No. 3, No. 4, No. 5, No. 6 and No. 7, respectively.

The film strength of individual photoconductive layers of the electrophotographic films No. 1 to No. 7, the adhesiveness of the individual photoconductive layers to the $In_2O_3$-evaporated PET film, and the specific sensitivity of the individual photoconductive layers determined. The results obtained are shown in Table 1.

The film strength of the photoconductive layer was expressed in terms of the diameter of the column at which the film fastened round the column with its photoconductive layer turned outside was cracked at the first place when a diameter of a column round which the film was to be wound was changed in turn from large to small. From a practical point of view, the value of film strength must not be larger than 5 mm, and should be 3 mm or less when the film is used as a rolled film. The extent of adhesiveness to the $In_2O_3$-evaporated PET film was evaluated as follows; The photoconductive layer was cut in a pattern of squares with a knife and thereto, cellophane tape (Panfix, trade name, Nichiban Co. Ltd.) was applied and then, it was peeled off with a strong pull. If no parts of the photoconductive layer are peeled off at all under the above-described condition, evaluation of the adhesiveness is represented by the mark ◎, if only a slight part (less than 1%) of the photoconductive layer is peeled off, evaluation of the adhesiveness is represented by the mark ○, and if some parts (1% or more) of the photoconductive layer are peeled off, evaluation of the adhesiveness is represented by the mark X. The specific sensitivity was evaluated by measuring the amount of light to which the photoconductive layer was exposed till the surface potential thereof was reduced to one-half its initial value through light decay.

EXAMPLE 2

Electrophotographic films No. 8 and No. 9 were prepared in the same manner as in electrophotographic films of Example 1 except that Saran Resin F-216 and Saran Resin R-200 were employed respectively instead of Saran Resin R-202. Furthermore, their addition amounts were set at 1 part by weight per 100 parts by weight of PVCz. The film strength, the adhesiveness to the $In_2O_3$-evaporated PET film, and the specific sensitivity of each electrophotographic film were determined according to the same methods as in Example 1. The results obtained are set forth in Table 1.

EXAMPLE 3

Electrophotographic films No. 10, No. 11, No. 12 and No. 13 were prepared in the same manner as in the electrophotograhic films No. 1, No. 2, No. 3 and No. 4 respectively except that 25 mg of Rhodamine B (C.I. #45170) was used instead of 25 mg of 2,6-di-t-butyl-4-[4-(N-methyl-N-2-cyanoethylaminostyryl]thiapyrylium tetrafluoroborate. The film strength, the adhesiveness to the $In_2O_3$-evaporated PET film, and the specific sensitivity of each electrophotographic film were determined according to the same methods as in Example 1. The results obtained are set forth in Table 1.

EXAMPLE 4

Electrophotographic films No. 14, No. 15, No. 16 and No. 17 were prepared in the same manner as in the electrophotographic films No. 1, No. 2, No. 3 and No. 4 respectively except that a PET film having a $SnO_2$ fine powder/gelatin layer prepared using the method described in Examples 1 and 2 of Japanese patent application No. 47665/80 was used instead of the $In_2O_3$-evaporated PET film of Example 1. The film strength, the adhesiveness to the $SnO_2$ fine powder/gelatin layer-applied PET film, and specific sensitivity of each electrophotographic film were determined according to the same methods as in Example 1. The results obtained are set forth in Table 1.

The PET film having $SnO_2$ fine powder dispersed in gelatin was prepared as follows:

(1) A mixture of 65 parts by weight of stannic chloride hydrate and 1.5 parts by weight of antimony trichloride was dissolved in 1,000 parts by weight of ethanol to prepare a uniform solution. To the uniform solution thus obtained was dropwise added a 1N aqueous sodium hydroxide solution until the pH of the solution reached 3 to thereby obtain co-precipitated colloidal stannic oxide and antimony oxide. The thus-obtained co-precipitated product was allowed to stand at 50° C. for 24 hours to obtain a red-brown colloidal precipitate.

The red-brown colloidal precipitate thus obtained was separated with a centrifugal separator. In order to remove excessive ions, water was added to the precipitate and the resulting mixture was subjected to centrifugal separation to wash the precipitate. This procedure was repeated three times to remove excessive ions.

The thus-obtained excessive ion-free colloidal precipitate (100 parts by weight) was mixed with 50 parts by weight of barium sulfate having an average grain size of 0.3μ and 1,000 parts by weight of water. The resulting mixture was sprayed in a burning furnace maintained at 900° C. to obtain a bluish powdery mixture comprising stannic oxide and barium sulfate and having an average grain size of 0.1μ.

The thus-obtained mixture (1 g) was placed in an insulative cylinder having an inner diameter of 1.6 cm. The specific resistance of the powder was measured with stainless steel electrodes while sandwiching the powder with the stainless steel electrodes at a pressure of 1,000 Kg/cm$^2$, and it was found to be 11 Ω-cm.

| | |
|---|---|
| (2) $SnO_2$ Powder obtained in the above step (1) | 10 parts by weight |
| Water | 150 parts by weight |
| 30% Aqueous Solution of Ammonia | 1 part by weight |

A mixture comprising the foregoing ingredients was dispersed for 1 hour with a paint shaker to obtain a uniform dispersion. This uniform dispersion was subjected to centrifugal separation at 2,000 rpm for 30 minutes to remove large particles. The supernatant liquid thus obtained was subjected to centrifugal separation at 3,000 rpm for 1 hour to obtain a $SnO_2$ paste comprising fine particles.

The thus-obtained $Sn_2O$ paste (10 parts by weight) was mixed with 25 parts by weight of a 10% aqueous solution of gelatin and 100 parts by weight of water, and the resulting mixture was dispersed for 1 hour with a paint shaker to obtain an electrically-conductive coating solution.

The electrically-conductive coating solution was coated on a 100 μm polyethylene terephthalate (PET) film in a dry coating amount of 2 g/m$^2$ to obtain an electrically-conductive support.

TABLE 1

| Electrophotographic Film No. | Flexibility | Adhesiveness | Specific Sensitivity |
|---|---|---|---|
| 1* | 10 mm | X | 100 |
| 2 | 7 mm | ○ | 94 |
| 3 | 4 mm | ◎ | 92 |
| 4 | 3 mm | ◎ | 85 |
| 5 | 3 mm | ◎ | 80 |
| 6 | not cracked | ◎ | 77 |
| 7 | not cracked | ◎ | 40 |
| 8 | 4 mm | ◎ | 93 |
| 9 | 4 mm | ◎ | 90 |
| 10* | 10 mm | X | 52 |
| 11 | 7 mm | ○ | 50 |
| 12 | 4 mm | ◎ | 47 |
| 13 | 3 mm | ◎ | 43 |
| 14* | 6 mm | ○ | 100 |
| 15 | 3 mm | ◎ | 93 |
| 16 | not cracked | ◎ | 92 |
| 17 | not cracked | ◎ | 84 |

*Comparative examples

It is apparent from the results of Examples 1 to 4 (Table 1) that the electrophotographic films having photoconductive layers made up of the compositions of the present invention (No. 2, No. 3, No. 4, No. 5, No. 6, No. 8, No. 9, No. 11, No. 12, No. 13, No. 15, No. 16 and No. 17) are excellent in mechanical strength, have good adhesiveness to base plates. Furthermore, the sensitivities of such films were reduced by a smaller extent as compared with electrophotographic films not containing vinylidene chloride-acrylonitrile copolymer (Comparative examples No. 1, No. 10 and No. 14).

While the invention has been described in detail and with reference to specific embodiment thereof, it will be apparent to one skilled in the art that various changes and modifications can be made therein without departing from the spirit and scope thereof.

What is claimed is:

1. A photoconductive composition, comprising;

an organic photoconductor of a molecular weight of about 100,000 to 1,000,000; and a vinylidene chloride-acrylonitrile copolymer, wherein the vinylidene chloride-acrylonitrile copolymer is present in an amount of 0.5 to 10 parts by weight per 100 parts by weight of the organic photoconductor.

2. A photoconductive composition as claimed in claim 1, wherein the photoconductor is comprised of $\pi$-electron systems having polycyclic aromatic rings in a main or side chain of the photoconductor.

3. A photoconductive composition as claimed in claim 1, wherein the photoconductor is comprised of $\pi$-electron systems having aromatic heterocyclic rings in a main or side chain of the photoconductor.

4. A photoconductive composition as claimed in claim 1, wherein the photoconductor is an N-vinylcarbazole copolymer containing an N-ethylenecarbazole repeating unit in a fraction of 50 mole % or more, the N-ethylenecarbazole unit being represented by the following general formula:

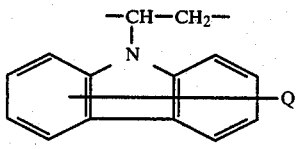

wherein Q is a substituent selected from the group consisting of an aryl group, an alkylaryl group, an amino group, an alkylamino group, a dialkylamino group, an arylamino group, a diarylamino group, an N-alkyl-N-arylamino group, a nitro group, or a halogen atom.

5. An electrophotographic photoreceptive material, comprising:

a support base having a conductive surface; and an electrophotographic photoreceptive layer positioned on the conductive surface, the electrophotographic photoreceptive layer being comprised of a photoconductive composition comprising an organic photoconductor of a molecular weight of about 100,000 to 1,000,000 and a vinylidene chloride-acrylonitrile copolymer, wherein the vinylidene chloride-acrylonitrile copolymer is present in an amount of 0.5 to 10 parts by weight per 100 parts by weight of the organic photoconductor.

6. An electrophotographic photoreceptive material as claimed in claim 5, wherein the photoconductor is comprised of $\pi$-electron systems having polycyclic aromatic rings in a main or side chain of the photoconductor.

7. An electrophotographic photoreceptive material as claimed in claim 5, wherein the photoconductor is comprised of $\pi$-electron systems having aromatic heterocyclic rings in a main or side chain of the photoconductor.

8. An electrophotographic photoreceptive material as claimed in claim 5, wherein the organic photoconductor is an N-vinylcarbazole copolymer comprising an N-ethylenecarbazole having a repeating unit in a fraction of 50 mole % or more, the N-ethylenecarbazole unit being represented by the following general formula:

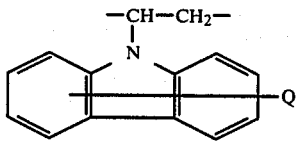

wherein Q is selected from the group consisting of an aryl group, an alkylaryl group, an amino group, an alkylamino group, a dialkylamino group, an arylamino group, a diarylamino group, an N-alkyl-N-arylamino group, a nitro group, or a halogen atom.

9. An electrophotographic photoreceptive material as claimed in claim 5, wherein the support base is rendered electrically conductive by evaporating a compound selected from the group consisting of a metal, $SnO_2$ or $In_2O_3$ thereon.

10. An electrophotographic photoreceptive material as claimed in claim 9, wherein the support base is comprised of drums or sheets of metal.

11. An electrophotographic photoreceptive material as claimed in claim 9, wherein the support base is comprised of paper sheets.

12. An electrophotographic photoreceptive material as claimed in claim 9, wherein the support base is comprised of plastic films.

13. An electrophotographic photoreceptive material as claimed in claim 9, wherein the support base is comprised of glass plates.

14. An electrophotographic photoreceptive material as claimed in claim 5, wherein the support base is comprised of $In_2O_3$ evaporated polyethylene terephthalate film.

15. An electrophotographic photoreceptive material as claimed in claim 5. wherein the support base is comprised of polyethylene terephthalate film having $SnO_2$ fine powder dispersed in gelatin.

16. An electrophotographic photoreceptive material as claimed in claim 9, wherein the organic photoconductor is an N-vinylcarbazole copolymer comprising an N-ethylenecarbazole having a repeating unit in a fraction of 50 mole % or more, the N-ethylenecarbazole unit being represented by the following general formula:

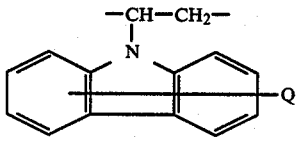

wherein Q is an aryl group, an alkylaryl group, an amino group, an alkylamino group, a dialkylamino group, an arylamino group, a diarylamino group, an N-alkyl-N-arylamino group, a nitro group, or a halogen atom.

17. An electrophotographic photoreceptive material, comprising:

a support base having a conductive surface;

an electrophotographic photoreceptive layer positioned on the conductive surface, the electrophotographic photoreceptive layer being comprised of a photoconductive composition comprising an organic photoconductor of a molecular weight of about 100,000 to 1,000,000 wherein said photoconductor possesses film forming ability; and a vinylidene chloride-acrylonitrile copolymer, wherein the vinylidene chloride-acrylonitrile copolymer is present in an amount of 0.5 to 10 parts by weight per 100 parts by weight of the organic photoconductor.

18. An electrophotographic photoreceptive material, comprising:

a support base having a conductive surface;

an electrophotographic photoreceptive layer positioned on the conductive surface, the electrophotographic photoreceptive layer being comprised of a photoconductive composition comprising an organic photoconductor of a molecular weight of about 100,000 to 1,000,000 wherein said photoconductor possesses film forming ability;

a vinylidene chloride-acrylonitrile copolymer, wherein the vinylidene chloride-acrylonitrile copolymer is present in an amount of 0.5 to 10 parts by weight per 100 parts by weight of the organic photoconductor; and a binder.

19. An electrophotographic photoreceptive material as claimed in claim 5, wherein the support base is rendered electrically conductive by laminating a metallic foil thereon.

20. An electrophotographic photoreceptive material as claimed in claim 5, wherein the support base is rendered electrically conductive by coating the support base with fine particles selected from the group consisting of a dispersion of $SnO_2$, $In_2O_3$, CuI, carbon black or a metal power dispersed in a binder polymer.

* * * * *